US008029392B2

(12) United States Patent
Bolen, III

(10) Patent No.: US 8,029,392 B2
(45) Date of Patent: Oct. 4, 2011

(54) EXPANDABLE BROADHEAD AND BLADES THEREFOR

(76) Inventor: Allen R. E. Bolen, III, Boulder City, NV (US)

( * ) Notice: Subject to any disclaimer, the term of this patent is extended or adjusted under 35 U.S.C. 154(b) by 736 days.

(21) Appl. No.: 11/880,922

(22) Filed: Jul. 25, 2007

(65) Prior Publication Data

US 2009/0029811 A1 Jan. 29, 2009

(51) Int. Cl.
*F42B 6/08* (2006.01)

(52) U.S. Cl. ..... 473/583

(58) Field of Classification Search ..... 473/578, 473/583, 584; 30/2, 346, 349, 351
See application file for complete search history.

(56) References Cited

U.S. PATENT DOCUMENTS

| | | | | |
|---|---|---|---|---|
| 4,167,810 | A * | 9/1979 | Gilbert | 30/2 |
| 4,209,900 | A * | 7/1980 | Gilbert | 30/162 |
| 6,322,464 | B1 | 11/2001 | Sestak | |
| 6,517,454 | B2 | 2/2003 | Barrie et al. | |
| 6,554,727 | B1 | 4/2003 | Armstrong et al. | |
| 6,595,881 | B1 | 7/2003 | Grace, Jr. et al. | |
| 6,669,586 | B2 | 12/2003 | Barrie et al. | |
| 6,910,979 | B2 | 6/2005 | Barrie et al. | |
| 6,938,345 | B2 * | 9/2005 | Yu | 30/123 |
| 7,226,375 | B1 | 6/2007 | Sanford | |

OTHER PUBLICATIONS

Pages 825-836 of a Catalog published by Cabelas, Inc. of Sidney, Nebraska, 2007.

* cited by examiner

*Primary Examiner* — John Ricci
(74) *Attorney, Agent, or Firm* — K&L Gates LLP

(57) ABSTRACT

An expandable broadhead and blades therefor that are configured to break or fracture upon contact with bone or the like to reduce the size of the blade and improve broadhead penetration.

12 Claims, 6 Drawing Sheets

EXPANDABLE BROADHEAD AND BLADES THEREFOR

FIELD OF THE INVENTION

The present invention relates in general to arrowheads used in the sport of hunting and, more particularly, to expandable broadheads with blades that are configured to open upon impact and break upon contact with bone or other difficult to penetrate tissues.

BACKGROUND

Perhaps one of the oldest tools known to man is the bow and arrow. Over the centuries, a vast number of advancements have been made to bows, arrows, and the tips used on arrows to harvest game. Unlike bullets which cause death by trauma, arrows are tipped with devices known as broadheads that are designed to cut tissue, arteries, veins, etc. to cause death from hemorrhaging.

The predecessor to the modern day broadhead comprised a head that was knapped or otherwise fashioned from flint or other materials that would tend to break and form sharp edges. Those heads were generally formed with two sharp edges and were then lashed onto an end of a wooden arrow shaft. Today, broadheads are made from metal and may have several sharpened cutting edges. In some modern day broadheads, the cutting edges are formed on portions of the broadhead body. Other modern day broadheads employ replaceable blades that may be readily replaced after they become dull.

Because broadheads are designed to kill by hemorrhaging, it is desirable for the cutting edges to be as large as possible. However, with modern day high speed bows, it is believed that large fixed blade broadheads may tend to undesirably steer the front end of the arrow and cause it to plane off target. To address such problems caused by fixed blade broadheads, expandable or "open on impact" broadheads were developed. In general, the blades in expandable broadheads are movable from a first position adjacent to the shaft to a second open position wherein the cutting edges thereof are positioned to cut tissue upon impact with the animal or target. When the blades are in the first position, they do not present surfaces that are prone to steer the arrow.

A variety of different expandable broadheads are known. Examples of such expandable broadheads are disclosed in U.S. Pat. No. 6,322,464 to Sestak, U.S. Pat. No. 6,517,454 to Barrie et al., U.S. Pat. No. 6,554,727 to Armstrong et al., U.S. Pat. No. 6,595,881 to Grace, Jr. et al., U.S. Pat. No. 6,669,586 to Barrie et al., U.S. Pat. No. 6,910,979 to Barrie et al., and U.S. Pat. No. 7,226,375 to Sanford, the disclosures of which are each herein incorporated by reference in their respective entireties. While such broadheads effectively addressed the steering problems encountered when using fixed blade broadheads, some hunters are reluctant to use such broadheads that are fashioned to provide large cutting diameters because it is believed that the those broadheads would have difficulty penetrating through areas where bone or other similar material is present.

Thus, there is a need for an expandable or open on impact broadhead that presents a large cutting diameter when the broadhead encounters normal fleshy tissues, yet provides a means for the blades to shorten upon contact with more difficult to penetrate areas and more rigid material such as bone.

SUMMARY

In one general aspect of an embodiment of the invention, there is provided a blade for an expandable broadhead. In various embodiments, the blade comprises a rearward blade portion that is configured for movable attachment to a broadhead shaft. The rearward blade portion may have a rearward cutting edge formed on at least a portion thereof. A forward blade portion that has a forward cutting edge formed thereon is attached to the rearward blade portion such that a weakened joint is formed therebetween.

In another general aspect of various embodiments of the present invention, there is provided a blade for an expandable broadhead. In various embodiments, the blade comprises a blade body that is configured for movable attachment to a broadhead shaft. The blade body may have a cutting edge and two lateral faces. A weakened area may be provided in at least one lateral face to define a forward blade portion and a rearward blade portion separatable from the forward blade portion along the weakened area.

In connection with another general aspect of the present invention, there is provided a blade for an expandable broadhead. In various embodiments, the blade comprises a blade body that is configured for movable attachment to a broadhead shaft. The blade body has a forward end and a rearward end and first and second opposed edges that extend between the forward end and second rearward end. A cutting edge may be formed on at least a portion of the first edge and at least one first weakened area may extends inward from the first edge.

In connection with another general aspect of the present invention, there is provided a blade for an expandable broadhead that has a broadhead shaft. In various embodiments, the blade comprises a blade body configured for movable attachment to the broadhead shaft. The body has a forward end and a rearward end and first and second opposed edges that extend between the forward end and second rearward end and serve to define a blade body width therebetween. The blade body has a length measured from said forward end to said rearward end. A cutting edge may be formed on at least a portion of the first edge and at least one weakened area may be provided in the second edge at a location located a distance from the rearward end that is not more than one half of the distance between the forward end and the rearward end. The weakened area may extend inward from the second edge a second distance that is at least half of the blade body width at that location.

In another general aspect of the present invention, there is provided an expandable broadhead that has an elongate shaft to which at least one of any of the foregoing blade embodiments may be movably attached.

These and other objects and advantages of the present invention shall be made apparent from the accompanying drawings and the description thereof.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain various principles of the present invention.

DETAILED DESCRIPTION

Figure 1:
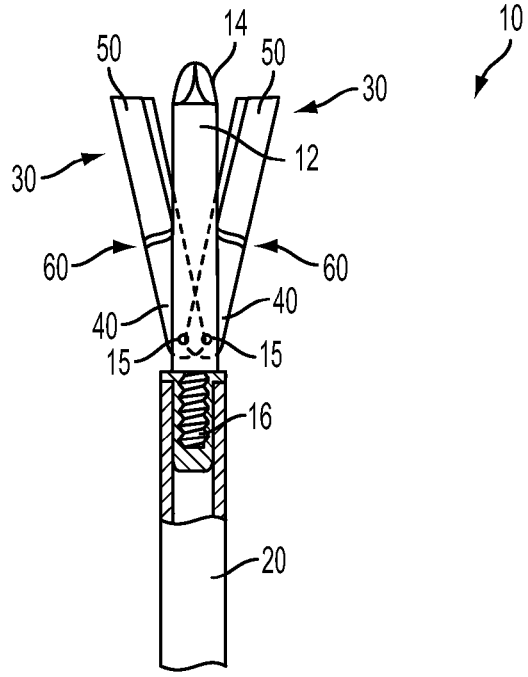
FIG. 1 is a view of an expandable or open on impact broadhead embodiment of the present invention with the blades thereof in a closed position attached to a portion of an arrow with some portions thereof shown in cross-section.
Figure 2:
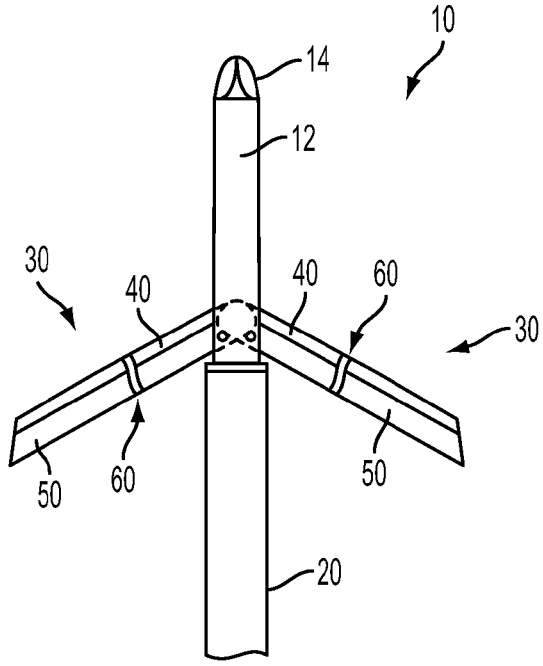
FIG. 2 is another view of the broadhead of FIG. 1 with the blades thereof in an open position.

Turning to the Drawings, wherein like numerals denote like components throughout the several views, FIGS. 1 and 2 depict an expandable broadhead 10 which is capable of practicing various unique benefits of the present invention. As can be seen in those Figures, one embodiment of the expandable broadhead 10 includes an elongate shaft portion 12 that has a tip 14 thereon and is configured to be attached to an arrow 20. In one embodiment, the shaft portion 12 may be provided with a threaded attachment portion 16 for attachment to a conventional arrow 20. The person of ordinary skill in the art will appreciate that the various embodiments of the present invention may be employed with a variety of different arrow configurations without departing from the spirit and scope of the present invention. For example, the expandable broadhead 10 may be successfully employed with arrows fabricated from, for example, aluminum, carbon, aluminum/carbon composite, wood, etc. In other embodiments (not shown), the elongate shaft portion 12 may be configured to be attached to the arrow 20 by an appropriate adhesive material or other known fastening arrangements. Those of ordinary skill in the art will appreciate that the tip 14 may have a variety of different shapes such as, for example, trocar shapes, pointed shapes, cutting tip shapes, etc.

The embodiment depicted in FIGS. 1 and 2 includes two blades 30 that are configured to be movably attached to the elongate shaft portion 12 such that the blades 30 can be positioned in a first "closed" position illustrated in FIG. 1 and move to a second "open" position when the blades 30 contact an object such as an animal or target. A variety of blade shapes, numbers of blades, and methods of movably attaching the blades to the broadhead shaft are known and are taught, for example, in the various U.S. patents that have been herein incorporated by reference. The blades depicted in the present Figures are examples of one type of blade configuration with which the unique and novel features of the present invention may be employed. Other blade attachment arrangements that may be employed in connection with the various embodiments of the present invention may comprise, for example, blades that can hinge backwards, slide rearward, scissor open, etc. In addition, while FIGS. 1 and 2 depict an embodiment wherein only two blades are employed other embodiments of the present invention may employ other numbers of blades. As the present Detailed Description proceeds, those of ordinary skill in the art will understand that the unique and novel features of the various embodiments of the present invention may be employed in connection with any of the blades described in the aforementioned patents and other known blade configurations employed in connection with expandable broadheads without departing from the spirit and scope of the present invention. Accordingly, the protection afforded to the various blade embodiments disclosed herein should not be so limited to the particular blade shape, number of blades and method of attachment to the broadhead shaft 12 depicted in the Figures.

Figure 3:
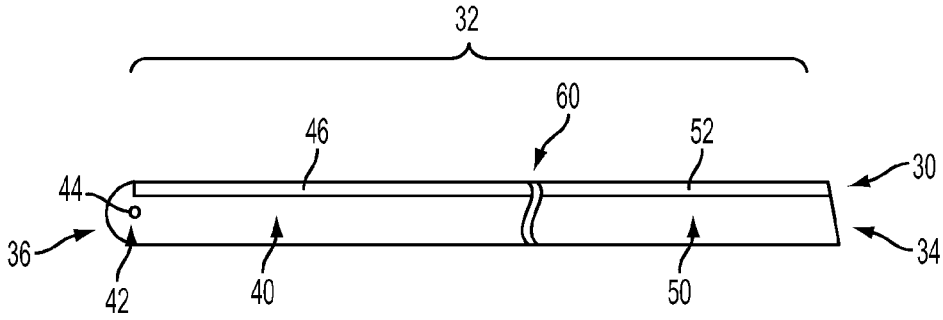
FIG. 3 is a side view of a blade embodiment of the present invention.

In the embodiments depicted in FIGS. 1-3, the blades 30 have a blade body 32 that has a forward end 34 and a rearward end 36. In various embodiments, the blade body 30 comprises a rearward blade portion 40 and a forward blade portion 50 that is attached to the rearward blade portion 40 by a weakened joint 60. The rearward blade portion 40 may have attachment means 42 for movably affixing the rearward blade portion 40 to the elongate shaft portion 12. In one embodiment, for example, the means 42 may comprise a hole, slot, etc. 44 sized to receive a pin or other member 15 to movably attach the blade 30 to the elongate shaft 12. The rearward blade portion 40 may have a cutting edge 46 and the forward blade portion 50 may have a cutting edge 52 formed thereon. The weakened joint 60 may attach the rearward blade portion 40 to the rearward blade portion 50 such that the forward cutting edge 52 is substantially aligned with the rearward cutting edge 46. However, other embodiments are contemplated wherein the forward cutting edge 52 is not substantially aligned with the rearward cutting edge 46.

In various embodiments, for example, the blade 30 may be fabricated from metal that may be sharpened. Such metal may comprise, for example, carbon steel, stainless steel, titanium, etc. The weakened joint 60 may be formed by brazing or soldering the forward blade portion 50 to the rearward blade portion 40. In other embodiments, the weakened joint 60 may be formed by an appropriate adhesive material. As used herein, the term "weakened joint" means an area that is weaker than the metal or other material forming the rearward blade portion 40 and the forward blade portion 50 such that the blade 30 is more likely to break along the weakened joint 60 and facilitate the detachment of the forward blade portion 50 from the rearward blade portion 40 when the blade 30 contacts material such as bone, cartilage, etc. The weakened joint may be located at an area that is substantially midway between the forward end 34 and the rearward end 36 or it may be located in other locations therebetween.

Figure 4:
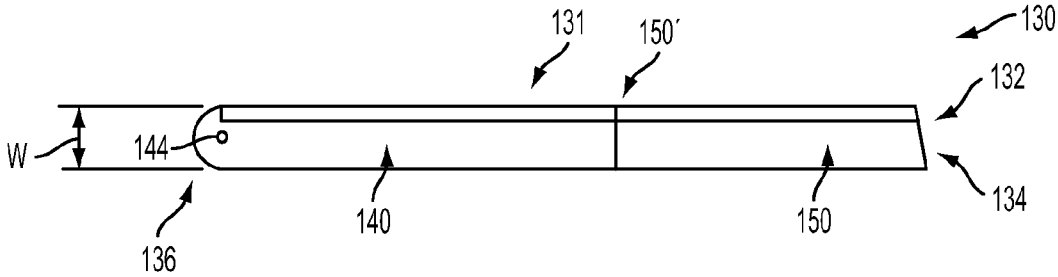
FIG. 4 is a side view of another blade embodiment of the present invention.
Figure 5:
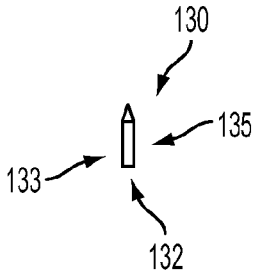
FIG. 5 is an end view of the blade in FIG. 4.

FIGS. 4 and 5 illustrate another blade embodiment of the present invention that may be fabricated from the various metal materials described above. In this embodiment, the blade 130 may have a blade body 132 that comprises a rearward blade portion 140 and a forward blade portion 150 that are separated by at least one score line 150'. The blade body 132 may otherwise have a cutting edge 131 formed thereon and a forward end 134 and a rearward end 136. A hole 144 or other attachment means may be provided through the blade body 132. The blade body 132 may also have a pair of lateral faces 132 and 133. See FIG. 5.

In one embodiment, the score line 150 is provided in one of the faces 132, 133. In other embodiments, a score line 150' is provided in each face 132, 133. In various embodiments, the score line 150' may extend continuously across the width "W" of the blade body 130. In other embodiments, the score line may not extend the entire width "W" and in still other embodiments, the score line 150' may be intermittent across the width "W" or segmented. The score line(s) 150' may be located in an area that is substantially midway between the forward end 134 and the rearward end 136 or the score line(s) may be located in other locations therebetween. The person of ordinary skill in the art will understand that the score line or score lines facilitate separation of the forward blade portion 150 from the rearward blade portion 140 upon contact with material such as bone or cartilage.

Figure 6:
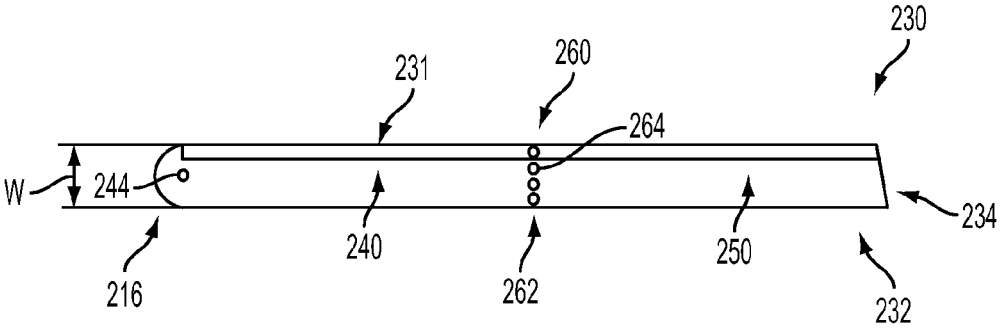
FIG. 6 is a side view of another blade embodiment of the present invention.

FIG. 6 illustrates another blade embodiment of the present invention that may be fabricated from the various metal materials described above. In this embodiment, the blade 230 may have a blade body 232 that comprises a rearward blade portion 240 and a forward blade portion 250 that are separated by at least one weakened area 260 in the form of a series 262 of small holes or dimples 264. The blade body 230 may otherwise have a cutting edge 231 formed thereon and a forward end 234 and a rearward end 216. A hole 244 or other attachment means may be provided through the body 232. In various embodiments, the series 262 may extend continuously across the width "W" of the blade body 230. In some embodiments, the holes 264 are substantially aligned with each other and in other embodiments, they may not be substantially aligned with each other. In some embodiments, the series 262 may not extend across the entire width "W". In other embodiments, a combination of holes and dimples may be employed. The series 262 may be located in an area that is substantially midway between the forward end 234 and the rearward end 236 or the series may be located in other locations therebetween. The person of ordinary skill in the art will understand that the holes, dimples or holes and dimples may facilitate separation of the forward blade portion 250 from the rearward blade portion 240 upon contact with material such as bone or cartilage.

Figure 7:
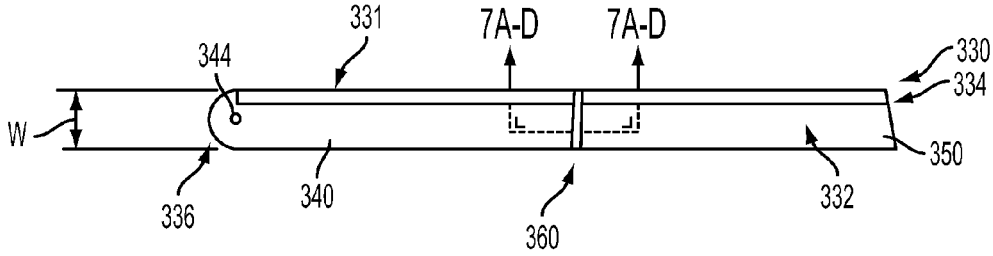
FIG. 7 is a side view of other blade embodiments of the present invention.
Figure 7A:
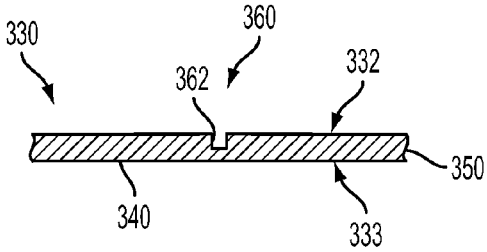
FIG. 7A is a partial cross-sectional view of a portion of a blade taken along line 7A-7A in FIG. 7.
Figure 7B:
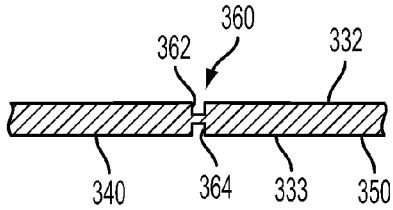
FIG. 7B is a partial cross-sectional view of a portion of a blade taken along line 7B-7B in FIG. 7.
Figure 7C:
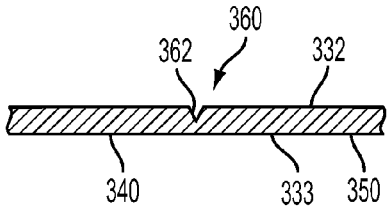
FIG. 7C is a partial cross-sectional view of a portion of a blade taken along line 7C-7C in FIG. 7.
Figure 7D:
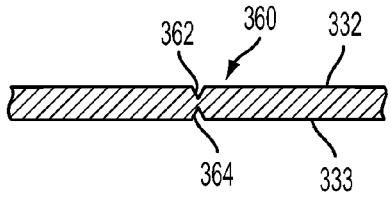
FIG. 7D is a partial cross-sectional view of a portion of a blade taken along line 7D-7D in FIG. 7.

FIG. 7 and FIGS. 7A-7D illustrate other blade embodiments of the present invention that may be fabricated from the various metal materials described above. In various embodiments, the blade 330 may have a blade body 332 that comprises a rearward blade portion 340 and a forward blade portion 350 that are separated by a weakened area 360 or an area that has a reduced cross-sectional thickness. The blade body 330 may otherwise have a cutting edge 331 formed thereon and a forward end 334 and a rearward end 336. A hole 344 or other attachment means may be provided through the body 332 for attachment to an elongate broadhead shaft 12. The blade body 332 may also have a pair of lateral faces 332 and 333. In the embodiment of FIG. 7A, the weakened area 360 comprises a groove 362 that is provided in face 332. In various embodiments the groove 362 may extend completely across the width "W" of the face 332. In other embodiments, the groove 362 may not extend completely across the face 332 and in still other embodiments, the groove 362 may be segmented. The groove 362 may be located in an area that is substantially midway between the forward end 334 and the rearward end 336 or the groove 362 may be located in other locations therebetween. In the embodiment depicted in FIG. 7B, a second groove 364 is provided in the face 333. Groove 364 may extend completely across the face 333 or it may not extend completely across the face 333. In other embodiments, the groove 362 may be segmented. In the embodiment depicted in FIG. 7C, the groove 362 may comprise a V-shaped groove in the face 332 and in the embodiment in FIG. 7D, the second groove 364 is also V-shaped. The person of ordinary skill in the art will understand that the grooves 362, 364 serve to reduce the cross-sectional area of the blade body 332 to create an area that is more susceptible to breakage to enable the forward blade portion 350 to be separated from the rearward blade portion 340.

Figure 8:
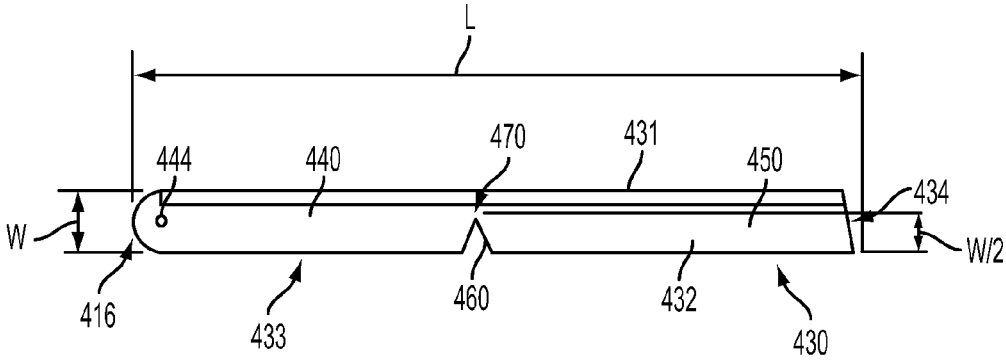
FIG. 8 is a side view of another blade embodiment of the present invention.
Figure 9:
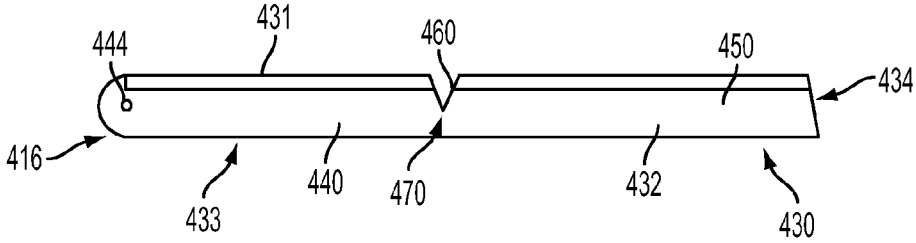
FIG. 9 is a side view of another blade embodiment of the present invention.
Figure 10:
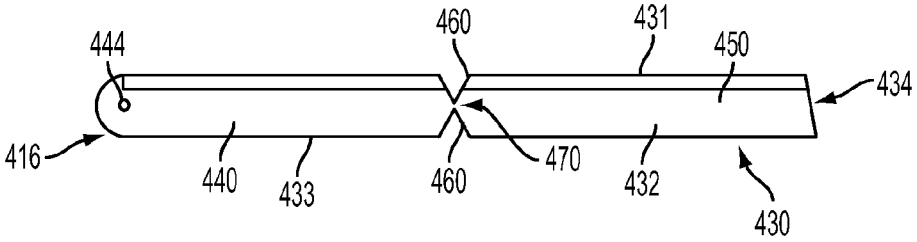
FIG. 10 is a side view of another blade embodiment of the present invention.

FIG. 8 illustrates another blade embodiment of the present invention that may be fabricated from the various metal materials described above. In this embodiment, the blade 430 may have a blade body 432 that has a first cutting edge 431 formed thereon and a second opposed edge 433. The first cutting edge 432 may extend the entire length "L" of the blade body 432 or it may not. The blade body 430 may also have a forward end 434 and a rearward end 416. A hole 444 or other attachment means may be provided through the blade body 432. In various embodiments, a substantially V-shaped notch 460 is provided in the second opposing edge 433 as shown. In some embodiments, the notch 460 may extend into the blade body 432 a distance that is equal to at least one half of the width "W" of the blade 430. In the embodiment depicted in FIG. 9, the notch 460 is provided in the first edge 431 and in the embodiment of FIG. 10, two notches 460 are provided. The notch(es) 460 may be located in an area that is substantially midway between the forward end 434 and the rearward end 436 or the notch(es) may be located in other locations therebetween. The person of ordinary skill in the art will understand that the notches 460 serve to define a smaller portion 470 of blade body 432 which may be broken or fractured when the blade 430 contacts material such as bone or cartilage to thereby facilitate separation of a forward blade portion 450 from a rearward blade portion 440.

Figure 11:
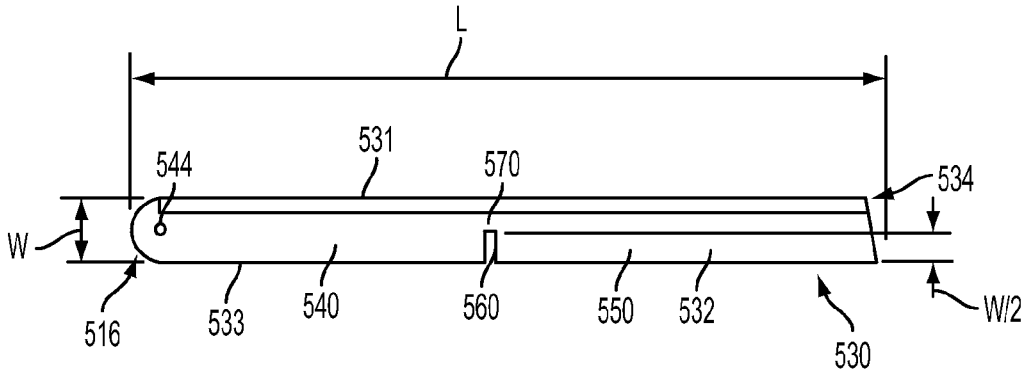
FIG. 11 is a side view of another blade embodiment of the present invention.
Figure 12:
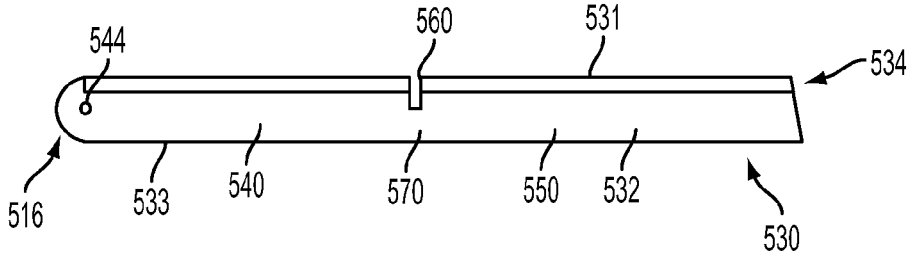
FIG. 12 is a side view of another blade embodiment of the present invention.
Figure 13:
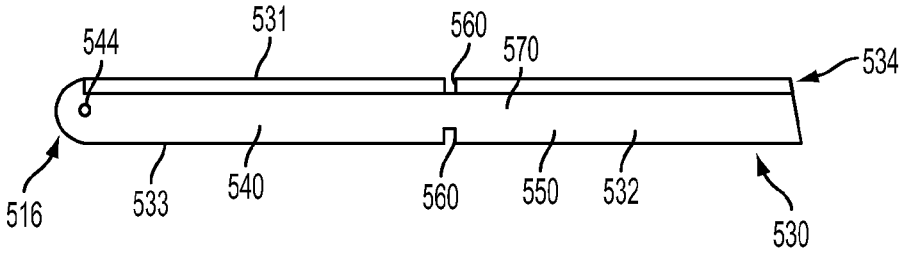
FIG. 13 is a side view of another blade embodiment of the present invention.

FIG. 11 illustrates another blade embodiment of the present invention that may be fabricated from the various metal materials described above. In this embodiment, the blade 530 may have a blade body 532 that has a first cutting edge 531 formed thereon and a second opposed edge 533. The first cutting edge 532 may extend the entire length "L" of the blade body 532 or it may not. The blade body 530 may also have a forward end 534 and a rearward end 516. A hole 544 or other attachment means may be provided through the blade body 532. In various embodiments, a substantially rectangular-shaped notch 560 is provided in the second opposing edge 533 as shown. In some embodiments, the notch 560 may extend into the blade body 532 a distance that is equal to at least one half of the width "W" of the blade 530. In the embodiment depicted in FIG. 12, the notch 560 is provided in the first edge 531 and in the embodiment of FIG. 13, two notches 560 are provided. The notch(es) 560 may be located in an area that is substantially midway between the forward end 534 and the rearward end 536 or the notch(es) 560 may be located in other locations therebetween. In other embodiments, the notch or notches may comprise a slit or a cut in the blade body 532. The person of ordinary skill in the art will understand that the notches 560 serve to define a smaller portion 570 of blade body 532 which may be broken or fractured when the blade 530 contacts material such as bone or cartilage to thereby facilitate separation of a forward blade portion 550 from a rearward blade portion 540.

Figure 14:
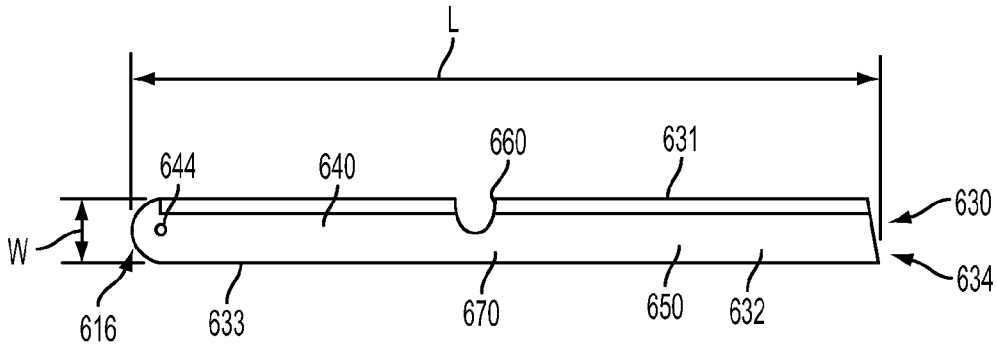
FIG. 14 is a side view of another blade embodiment of the present invention.
Figure 15:
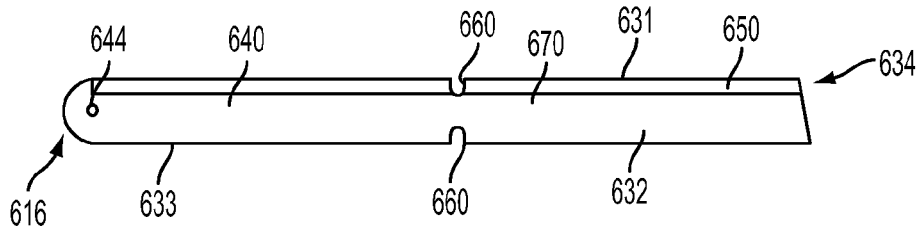
FIG. 15 is a side view of another blade embodiment of the present invention.
Figure 16:
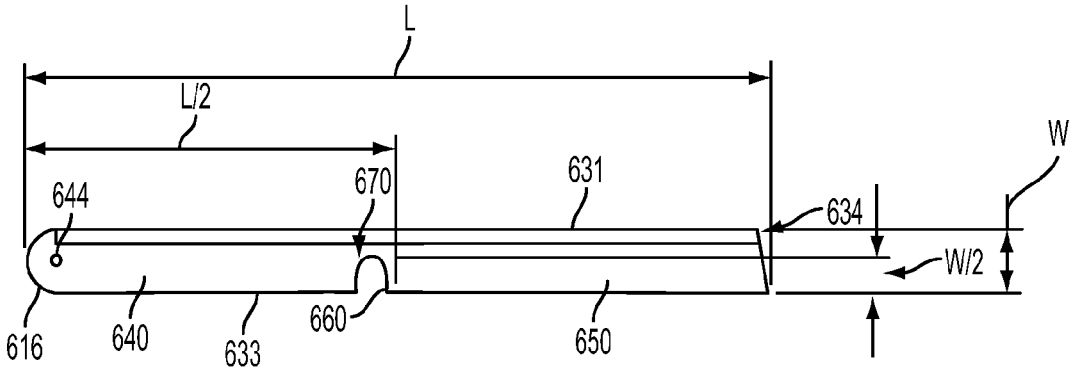
FIG. 16 is a side view of another blade embodiment of the present invention.

FIG. 14 illustrates another blade embodiment of the present invention that may be fabricated from the various metal materials described above. In this embodiment, the blade 630 may have a blade body 632 that has a first cutting edge 631 formed thereon and a second opposed edge 633. The first cutting edge 631 may extend the entire length "L" of the blade body 632 or it may not. The blade body 630 may also have a forward end 634 and a rearward end 616. A hole 644 or other attachment means may be provided through the blade body 632. In various embodiments, a notch 660 with a substantially arcuate bottom is provided in the cutting edge 631 as shown. In some embodiments, the notch 660 may extend into the blade body 632 a distance that is equal to at least one half of the width "W" of the blade 630. The notch 660 (in FIG. 14) may be located in an area that is substantially midway between the forward end 634 and the rearward end 636 or the notch 660 may be located in other locations therebetween. In the embodiment depicted in FIG. 15, two notches 660 are provided. Those notches 660 may be located in an area that is substantially midway between the forward end 634 and the rearward end 636 or the notches 660 may be located in other locations therebetween. In the embodiment depicted in FIG. 16, the notch 660 is provided in the second opposing edge 633 and is located at a distance "L/2" from the rearward end 616 that is not more than one half of the length "L" of the blade 630 and extends into the blade body a distance "W/2" that is at least one half of the width "W" of the blade body 630. The person of ordinary skill in the art will understand that the notches 660 serve to define a smaller portion 670 of blade body 632 which may be broken or fractured when the blade 630 contacts material such as bone or cartilage to thereby facilitate separation of a forward blade portion 650 from a rearward blade portion 640.

The person of ordinary skill in the art will readily appreciate that the broadhead embodiments and blade embodiments of the present invention represent a vast improvement over prior expandable or open on impact broadheads. By providing such broadhead blades that are configured to facilitate breakage of a forward portion of the blade from a rearward portion of the blade upon contact with substantially solid material bone (non-soft tissue or non-organ material), penetration of the broadhead is improved. By facilitating breakage of portions of the blade or blades upon contact with bone or the like permits the remaining portion of the broadhead (e.g., the shaft and other blades) to continue to pass into the target animal and cut tissue.

A variety of blade embodiments have been disclosed. The weakened area between a forward blade portion and a rearward blade portion to facilitate detachment of the forward blade portion from the rearward blade portion may be formed by brazing, soldering or gluing the forward blade portion to the rearward blade portion in such a manner so that the joint formed therebetween is not as strong as the metal or other material forming the forward blade portion and rearward blade portion. Such arrangement facilitates breakage of the blade body along the weakened joint upon contact with a solid material such as bone or the like.

In still other embodiments, the blade body is provided with an area that has a cross-sectional thickness that is less than the cross-sectional thickness of other portions of the blade body. Such arrangements make the blade more susceptible to breakage in the area of reduced cross-sectional thickness upon contact with solid material such as bone. The area of reduced cross-sectional thickness may be formed by one or more grooves, score lines, dimples, etc.

In other embodiments, the weakened area or area that is more susceptible to fracture or breakage may be formed by providing one or more notches, slits, or holes in the blade body. The notches may comprise a substantially V-shaped notch in one or both of the elongate blade edges. The notches may also be substantially square shaped or substantially rectangular shaped. In other embodiments, the notches may be formed from a portion of a round hole or comprise a notch with an arcuate bottom.

The locations of the weakened joint or weakened areas, notches, slits, grooves, holes, dimples, etc. may be selected to lie between a forward end of the blade and a rearward end of the blade. In some embodiments, for example, those features may be substantially midway between the forward blade end and the rearward blade end. It will be understood that, the closer that those features are placed to the forward end of the blade, the utility gained by breakage of the forward portion of the blade will decrease because the length of rearward blade portion will not have been significantly shortened. On the other hand, the closer that those features are placed to the rearward end of the blade, the penetration utility will likely increase with the detachment of the forward blade portion. However, the remaining rearward blade portion will have a smaller cutting edge to sever tissue as it continues to penetrate.

While several embodiments of the invention have been described, it should be apparent, however, that various modifications, alterations and adaptations to those embodiments may occur to persons skilled in the art with the attainment of some or all of the advantages of the invention. For example, according to various embodiments, a single component may be replaced by multiple components, and multiple components may be replaced by a single component, to perform a given function or functions. This application is therefore intended to cover all such modifications, alterations and adaptations without departing from the scope and spirit of the disclosed invention as defined by the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The invention which is intended to be protected is not to be construed as limited to the particular embodiments disclosed. The embodiments are therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. A blade for an expandable broadhead having a broadhead shaft, said blade comprising:

a blade body configured for movable attachment to the broadhead shaft, said blade body having a forward end and a rearward end and first and second opposed edges extending between said forward end and said rearward end and defining a blade body width therebetween, said blade body having a length measured from said forward end to said rearward end;

a cutting edge formed on at least a portion of said first edge; and at least one weakened area provided in said second edge at a location located a distance from said rearward end that is not more than one half of the distance between said forward end and said rearward end, said weakened area extending inward from said second edge a second distance that is at least half of the blade body width at said location.

2. The blade of claim 1 wherein said weakened area comprises weakened area selected from the group of weakened areas consisting of a notch and a slit.

3. An expandable broadhead, comprising:

an elongate shaft portion; and at least one broadhead blade according to claim 1 movably coupled to said elongate shaft portion.

4. An expandable broadhead, comprising:

an elongate shaft portion; and at least one broadhead blade comprising:

a rearward blade portion configured for movable attachment to said elongate shaft portion, said rearward blade portion having a rearward cutting edge formed on at least a portion thereof; and a forward blade portion having a forward cutting edge formed on at least a portion thereof and being attached to said rearward blade portion such that a weakened joint is formed therebetween, wherein said weakened joint has a cross-sectional thickness that is less than a cross-sectional thickness of at least one of said forward and rearward blade portions.

5. An expandable broadhead, comprising:

an elongate shaft portion; and at least one broadhead blade comprising:

a blade body configured for movable attachment to said elongate shaft portion, said blade body having a cutting edge and lateral faces; and at least one score line in at least one lateral face of said blade body to define a forward blade portion and a rearward blade portion separatable from said forward blade portion along said at least one score line.

6. An expandable broadhead comprising:

an elongate shaft;

a rearward blade portion movably coupled to the elongate shaft, said rearward blade portion having a rearward cutting edge formed on at least a portion thereof; and a forward blade portion having a forward cutting edge formed on at least a portion thereof and being attached to said rearward blade portion such that a weakened joint is formed therebetween by brazing said forward blade portion to said rearward blade portion.

7. An expandable broadhead comprising:

a broadhead shaft;

a rearward blade portion movably attached to the broadhead shaft, said rearward blade portion having a rearward cutting edge formed on at least a portion thereof; and a forward blade portion having a forward cutting edge formed on at least a portion thereof and being attached to said rearward blade portion such that a weakened joint is formed therebetween by soldering said forward blade portion to said rearward blade portion.

8. An expandable broadhead comprising:

a broadhead shaft;

a rearward blade portion movably attached to the broadhead shaft, said rearward blade portion having a rearward cutting edge formed on at least a portion thereof; and a forward blade portion having a forward cutting edge formed on at least a portion thereof and being attached to said rearward blade portion such that a weakened joint is formed therebetween by gluing said forward blade portion to said rearward blade portion.

9. An expandable broadhead, comprising:

an elongate shaft portion; and at least one broadhead blade comprising:

a blade body configured for movable attachment to the elongate shaft portion, said blade body having a cutting edge and lateral faces; and a weakened area in at least one lateral face of said blade body to define a forward blade portion and a rearward blade portion separatable from said forward blade portion along said weakened area wherein said weakened area has a cross-sectional thickness that is less than a cross-sectional thickness of at least one of said forward and rearward blade portions.

10. An expandable broadhead, comprising:

an elongate shaft portion; and at least one broadhead blade comprising:

a blade body configured for movable attachment to the elongate shaft portion, said blade body having a cutting edge and lateral faces; and a weakened area in at least one lateral face of said blade body to define a forward blade portion and a rearward blade portion separatable from said forward blade portion along said weakened area wherein said weakened area extends across a width of at least one entire lateral face.

11. An expandable broadhead, comprising:

an elongate shaft portion; and at least one broadhead blade comprising:

a blade body configured for movable attachment to the elongate shaft portion, said blade body having a cutting edge and lateral faces; and at least one V-shaped groove in at least one lateral face of said blade body to define a forward blade portion and a rearward blade portion separatable from said forward blade portion along said V-shaped groove.

12. An expandable broadhead, comprising:

an elongate shaft portion; and at least one broadhead blade comprising:

a blade body configured for movable attachment to the elongate shaft, said blade body having a forward end and a rearward end and first and second opposed edges extending between said forward end and second rearward end;

a cutting edge formed on at least a portion of said first edge; and at least one first weakened area extending inward from said first edge.

* * * * *